US010794350B1

(12) United States Patent
Lamb et al.

(10) Patent No.: US 10,794,350 B1
(45) Date of Patent: Oct. 6, 2020

(54) FUEL LINE ASSEMBLY HAVING A FUEL LINE AND A FUEL INJECTOR SOCKET

(71) Applicant: DELPHI TECHNOLOGIES IP LIMITED, St. Michael (BB)

(72) Inventors: Curtis D. Lamb, West Henrietta, NY (US); Christopher M. Cass, Arlington Heights, IL (US)

(73) Assignee: DELPHI TECHNOLOGIES IP LIMITED (BB)

( * ) Notice: Subject to any disclaimer, the term of this patent is extended or adjusted under 35 U.S.C. 154(b) by 0 days.

(21) Appl. No.: 16/527,519

(22) Filed: Jul. 31, 2019

(51) Int. Cl.
*F02M 61/14* (2006.01)
*F02M 69/46* (2006.01)

(52) U.S. Cl.
CPC ..... *F02M 61/14* (2013.01); *F02M 69/465* (2013.01); *F02M 2200/856* (2013.01)

(58) Field of Classification Search
CPC . F02M 61/14; F02M 69/465; F02M 2200/856
See application file for complete search history.

(56) References Cited

U.S. PATENT DOCUMENTS 6,830,037 B1 12/2004 Braun et al.
7,406,946 B1 8/2008 Watanabe et al.
2003/0106535 A1 6/2003 Zdroik et al.
2006/0254563 A1 11/2006 Keegan et al.
2009/0184512 A1 7/2009 Giorgetti et al.
2013/0036607 A1 2/2013 Takasaki et al.
2016/0273501 A1* 9/2016 Cass ..... F02M 61/14
2016/0290300 A1 10/2016 Graham et al.

FOREIGN PATENT DOCUMENTS

WO 2012150072 A1 11/2012

* cited by examiner

*Primary Examiner* — Xiao En Mo
(74) *Attorney, Agent, or Firm* — Joshua M. Haines

(57) ABSTRACT

A fuel line assembly includes a fuel line having has an inner surface and an outer surface joined to each other by a fuel line aperture. A fuel injector socket has at one end a fixation saddle which is concave within which the fuel line is received such that the fixation saddle has a concave surface facing toward the fuel line. A fuel injector socket receiving bore extends into another end of the fuel injector socket to receive a fuel injector therewithin. A fuel injector socket aperture extends from the concave surface to the fuel injector socket receiving bore. An alignment tube provides fluid communication between the inner surface and the fuel injector socket receiving bore, wherein a portion of the alignment tube is circumferentially surrounded by the fuel line aperture and wherein another portion of the alignment tube is circumferentially surrounded by the fuel injector socket aperture.

16 Claims, 8 Drawing Sheets

FUEL LINE ASSEMBLY HAVING A FUEL LINE AND A FUEL INJECTOR SOCKET

TECHNICAL FIELD OF INVENTION

The present invention relates to a fuel line assembly which supplies fuel to a fuel injector of a fuel consuming device and more particularly to a connection between a fuel line and a fuel injector socket of the fuel line assembly.

BACKGROUND OF INVENTION

Fuel injection systems that deliver fuel to fuel consuming devices, for example internal combustion engines, have been known for many years. In modern internal combustion engines, it is increasingly common to provide fuel injectors which inject fuel, for example gasoline, directly into combustion chambers of the internal combustion engine. These internal combustion engines commonly include multiple combustion chambers, and consequently, each combustion chamber is provided with a respective fuel injector to inject fuel therein. A common conduit, typically referred to as a fuel rail, includes an inlet which receives fuel from a fuel source, such as one or more fuel pumps, and also includes a plurality of injectors sockets which each receive an inlet end of a respective fuel injector in order to communicate fuel to each fuel injector.

Typical fuel rails have a large internal volume in order to aid in damping pressure pulsations created by the rapid cyclic opening and closing of the fuel injectors. For example, the inside diameter of the fuel rail may be on the order of 13 mm. In order to provide structural integrity at the pressures experienced by the fuel rail, the outside diameter is on the order of 31 mm, thereby resulting in a wall thickness on the order of 4 mm. The large diameter and wall thickness of conventional fuel rails requires the fuel rail to be linear, and consequently, does not allow for the fuel rail to be routed around other components of the internal combustion engine. As a result, it may be desirable to replace the fuel rail with a fuel line which is sized to be similar to a supply line which supplies fuel from the fuel pump to the conventional fuel rail. For example, the fuel line may have an outside diameter of 10 mm or less, an inside diameter of 6 mm or less, and a wall thickness of 2 mm or less which allows the fuel line to bent and formed into non-linear shapes in order to be routed around other components of the internal combustion engine. However, using such a fuel line decreases the pressure pulsation damping attributes of the conventional fuel rail having a large internal volume. Furthermore, the conventional techniques for joining the fuel injector sockets to the fuel rail may not translate well to joining the fuel injector socket to such a fuel line due to the drastic reduction in size of the fuel line compared to the fuel rail. Additional benefits of using such a fuel line are to reduce mass, reduce cost, and reduce the number of connections by using a single fuel tube to provide fluid communication from the fuel pump to the fuel injectors.

What is needed is a fuel line assembly which provides a connection to a fuel injector which minimizes or eliminates one or more of the shortcomings set forth above.

SUMMARY OF THE INVENTION

Briefly described, a fuel line assembly is provided which supplies fuel to a fuel injector of a fuel consuming device. The fuel line assembly includes a fuel line having a fuel line tubular wall which extends along a fuel line axis and has a fuel line inner surface and a fuel line outer surface such that a fuel line aperture extends from the fuel line outer surface to the fuel line inner surface; a fuel injector socket which is tubular and which extends from a fuel injector socket first end to a fuel injector socket second end, the fuel injector socket having a fuel injector socket fixation saddle which is concave at the fuel injector socket first end within which the fuel line is received such that the fuel injector socket fixation saddle has a concave surface facing toward the fuel line, the fuel injector socket also having a fuel injector socket receiving bore extending thereinto from the fuel injector socket second end which is configured to receive the fuel injector therewithin, the fuel injector socket also having a fuel injector socket aperture extending from the concave surface to the fuel injector socket receiving bore; and an alignment tube extending from an alignment tube first end to an alignment tube second end, the alignment tube having an alignment tube passage extending therethrough from the alignment tube first end to the alignment tube second end, the alignment tube also having an alignment tube outer peripheral surface such that a portion of the alignment tube outer peripheral surface is circumferentially surrounded by the fuel line aperture and such that another portion of the alignment tube outer peripheral surface is circumferentially surrounded by the fuel injector socket aperture such that the alignment tube passage provides fluid communication between the fuel line inner surface and the fuel injector socket receiving bore.

The fuel line assembly as described herein allows the fuel line to have a relatively small wall thickness which can be easily shaped to be non-linear, thereby allowing for easier packaging of the fuel line assembly on internal combustion engines. Furthermore, pressure pulsation damping characteristics can be easily tailored by selecting the diameter and length of the alignment tube passage. Even furthermore, alignment of the fuel injector socket to the fuel line can be maintained during manufacturing of the fuel line assembly through use of the alignment tube.

BRIEF DESCRIPTION OF DRAWINGS

This invention will be further described with reference to the accompanying drawings in which.

DETAILED DESCRIPTION OF INVENTION

Figure 1:
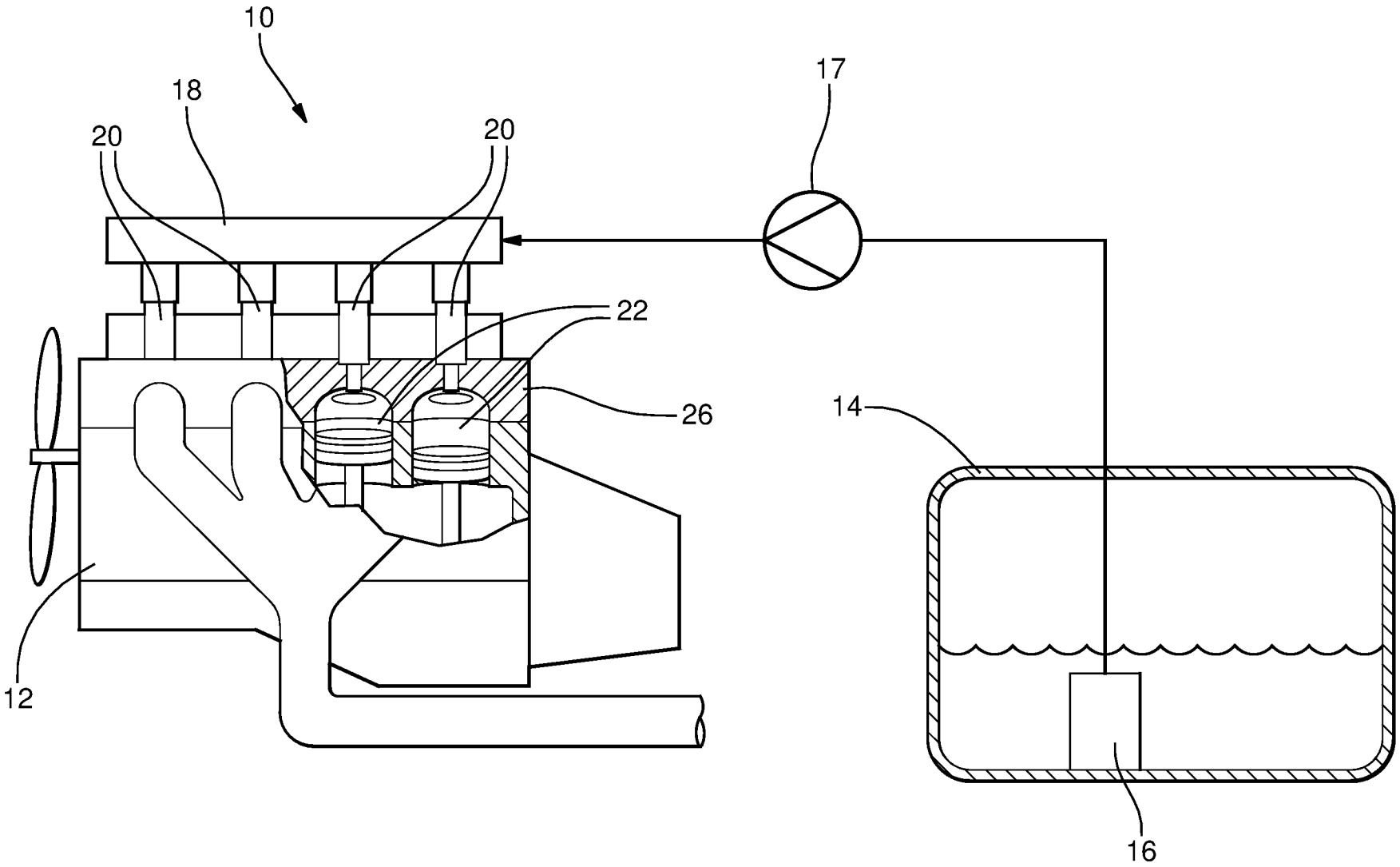
FIG. 1 is a schematic view of a fuel system in accordance with the present disclosure.
Figure 2:
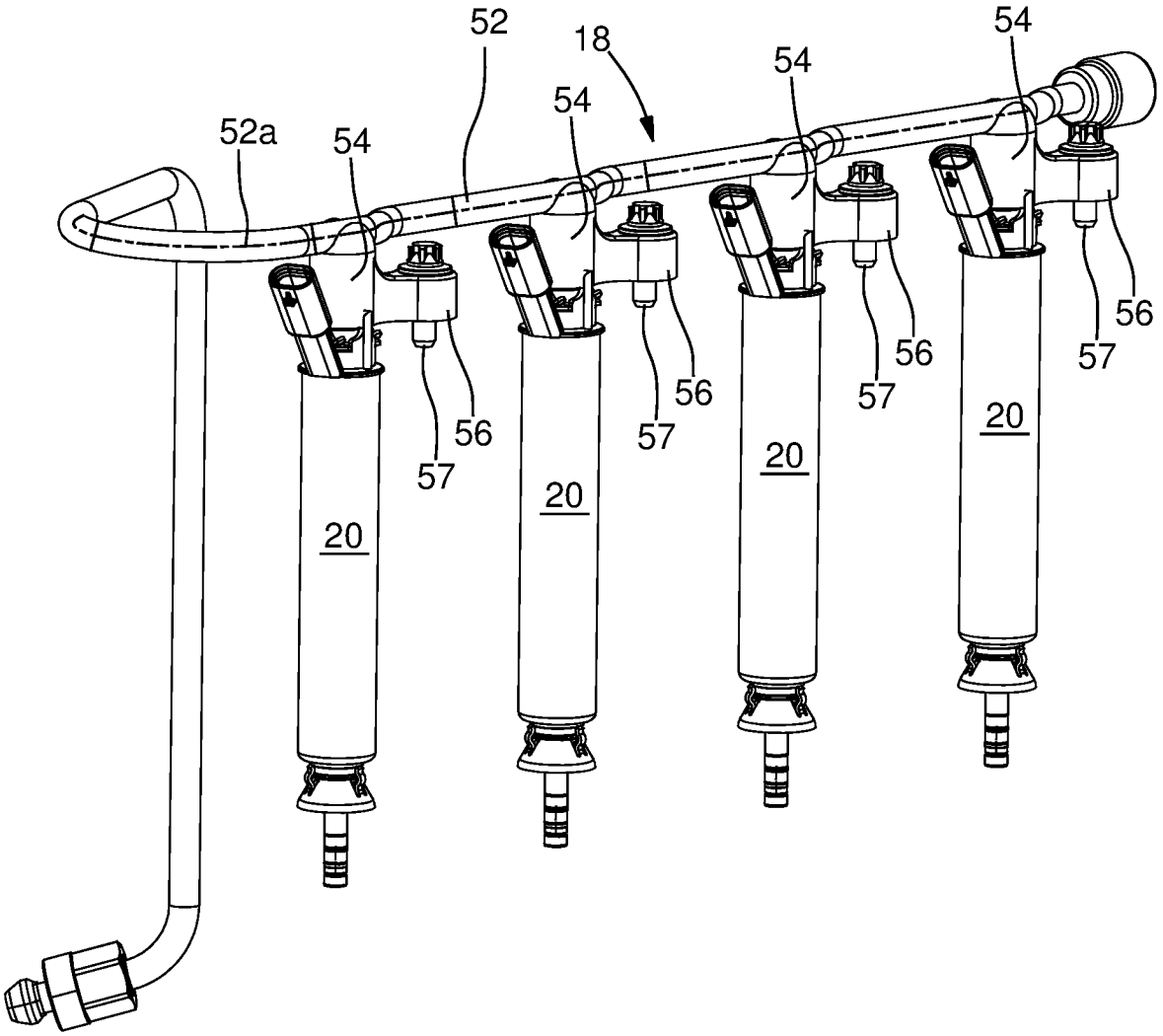
FIG. 2 is an isometric view of a fuel line assembly in accordance with the present disclosure.

Referring initially to FIG. 1, a fuel system 10 is shown in simplified schematic form for supplying fuel to a fuel consuming device, for example an internal combustion engine 12, by way of non-limiting example only, for a motor vehicle (not shown). Fuel system 10 includes a fuel tank 14 for storing a volume of fuel, a low-pressure fuel pump 16 which may be located within fuel tank 14 as shown, a high-pressure fuel pump 17 which receives fuel from low-pressure fuel pump 16, a fuel line assembly 18 attached to internal combustion engine 12 and in fluid communication with high-pressure fuel pump 17, and a plurality of fuel injectors 20 in fluid communication with fuel line assembly 18. In operation, low-pressure fuel pump 16 draws fuel from fuel tank 14 and pumps the fuel to high-pressure fuel pump 17 under relatively low pressure, for example about 500 kPa. High-pressure fuel pump 17, which may be a piston pump operated by a cam of internal combustion engine 12, further pressurizes the fuel and supplies the fuel to fuel line assembly 18 under relatively high pressure, for example, above about 14 MPa and even reaching 35 MPa or higher. Each fuel injector 20 receives fuel from fuel line assembly 18 and injects the fuel into a respective combustion chamber 22 of internal combustion engine 12 for combustion of the fuel within combustion chambers 22.

Figure 7:
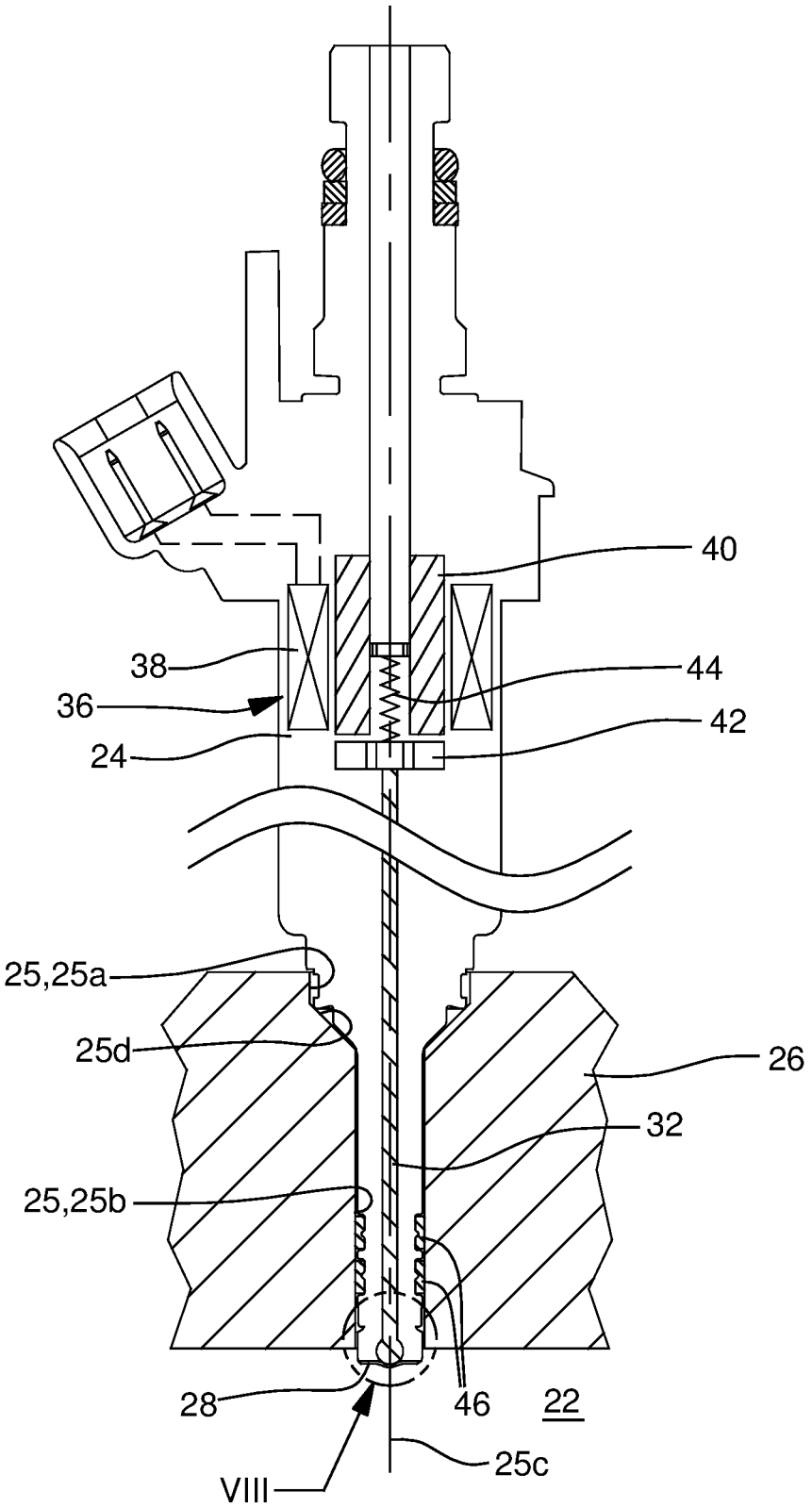
FIG. 7 is a schematic view of internal workings of a fuel injector of FIG. 2.
Figure 8:
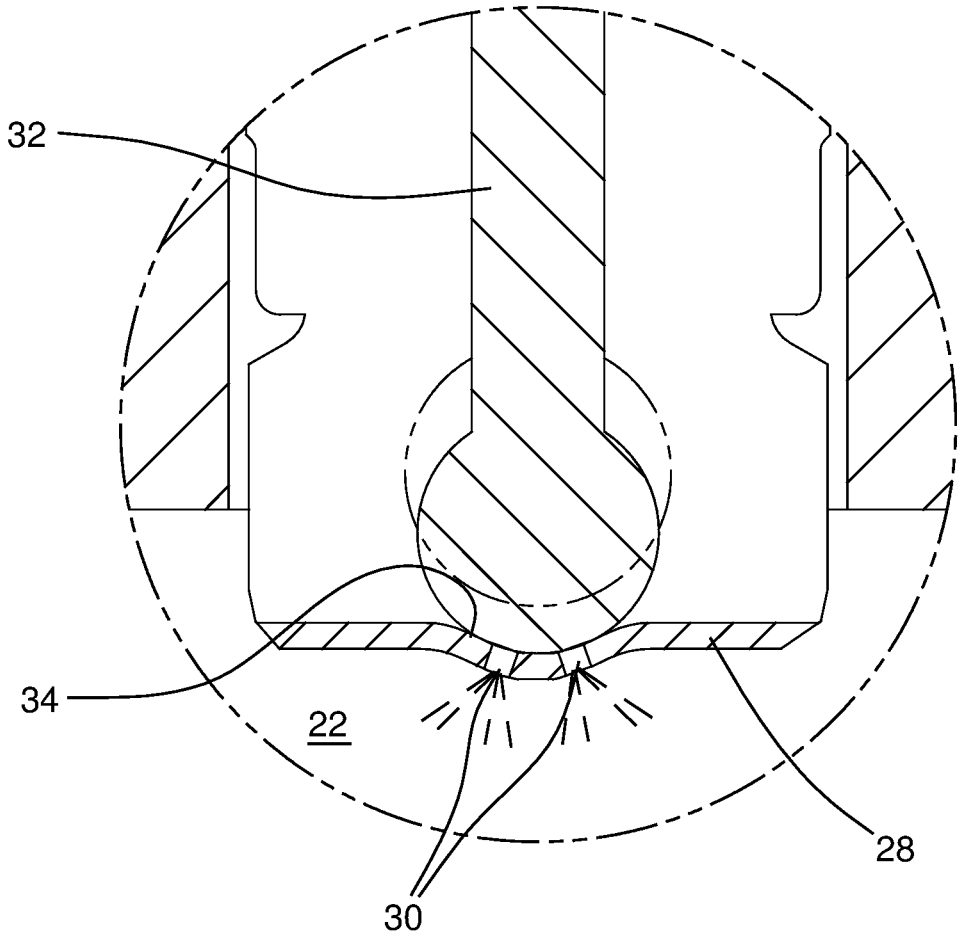
FIG. 8 is an enlargement of a portion of FIG. 7.

Referring now to FIGS. 7 and 8, fuel injector 20, the internal workings of which are shown in schematic form, includes a fuel injector body 24 which is configured to be inserted into a fuel injector receiving bore 25 of a cylinder head 26 of internal combustion engine 12 such that a nozzle tip 28 of fuel injector body 24 communicates with combustion chamber 22 and includes one or more nozzle openings 30 therein from which fuel is selectively discharged from fuel injector 20 into combustion chamber 22. The discharge of fuel from nozzle openings 30 is controlled by a valve needle 32 located within fuel injector body 24 where valve needle 32 is selectively seated with a valve seat 34 (valve needle 32 being shown in solid lines in FIG. 8) to stop discharge of fuel through nozzle openings 30 and is selectively unseated with valve seat 34 (valve needle 32 being shown in phantom lines in FIG. 8) to discharge fuel from fuel injector 20 into combustion chamber 22. Movement of valve needle 32 is controlled by an actuator 36, illustrated herein as a solenoid actuator. As embodied herein, actuator 36 includes a wire winding 38, a pole piece 40 which is stationary, an armature 42 which is moveable with valve needle 32, and a return spring 44 which urges valve needle 32 in a direction to be seated with valve seat 34. When wire winding 38 is energized with an electric current, armature 42 is magnetically attracted to pole piece 40, thereby unseating valve needle 32 from valve seat 34. Conversely, when the electric current to wire winding 38 is stopped, the magnetic attraction between armature 42 and pole piece 40 is stopped, thereby allowing return spring 44 to move valve needle 32 to be seated with valve seat 34. While actuator 36 has been illustrated herein as a solenoid actuator, it should be understood that actuator 36 may take other forms, which may be, by way of non-limiting example only, a piezoelectric actuator. Furthermore, while actuator 36 has been illustrated as directly actuating valve needle 32, it should be understood that actuator 36 may be indirect acting such that the actuator may be used to control fuel pressure in a control chamber such that the fuel pressure in the control chamber affects the position of valve needle 32. Fuel injector 20 includes a fuel injector inlet conduit 50 which receives fuel from fuel line assembly 18 for selective injection into combustion chamber 22.

Fuel injector receiving bore 25 is a stepped bore which includes at least two sections of distinct diameter such that a fuel injector receiving bore outer portion 25*a* is distal from combustion chamber 22 and such that a fuel injector receiving bore inner portion 25*b* is proximal to combustion chamber 22. Fuel injector receiving bore outer portion 25*a* and fuel injector receiving bore inner portion 25*b* are each centered about a fuel injector receiving bore axis 25*c*, however, fuel injector receiving bore outer portion 25*a* is larger in diameter than fuel injector receiving bore inner portion 25*b*. Fuel injector 20 includes one or more combustion seals 46 which are disposed radially between fuel injector body 24 and fuel injector receiving bore inner portion 25*b*, thereby preventing combustion gases from passing between the interface of fuel injector body 24 and fuel injector receiving bore inner portion 24*b*. A fuel injector receiving bore shoulder 25*d* is formed between fuel injector receiving bore outer portion 25*a* and fuel injector receiving bore inner portion 25*b* such that fuel injector receiving bore shoulder 25*d* is perpendicular, inclined, or a combination of perpendicular and inclined to fuel injector receiving bore axis 25*c*.

Now with reference to FIGS. 2-6, fuel line assembly 18 includes a fuel line 52 which extends along a fuel line axis 52*a*. Fuel line 52 is tubular such that fuel line 52 includes a fuel line tubular wall 52*b* extending along fuel line axis 52*a* and includes a fuel line inner surface 52*c* and a fuel line outer surface 52*d*. Fuel line assembly 18 also includes a plurality of fuel injector sockets 54 which are fixed to fuel line 52. Each fuel injector socket 54 is tubular and configured to receive a respective one of fuel injectors 20 as will be described later in greater detail. Fuel line assembly 18 also includes a plurality of alignment tubes 58 which provide alignment between fuel injector sockets 54 and fuel line 52 during manufacturing of fuel line assembly 18 and also provide pulsation damping during operation of fuel injectors 20. Fuel line 52, fuel injector sockets 54, and alignment tubes 58 will be described in greater detail in the paragraphs that follow.

Fuel line 52 will now be described in greater detail. Fuel line 52 is made of metal and may be, by way of non-limiting example only, stainless steel such as 304 stainless steel in order to be resistive to corrosive fuel such as gasoline. Unlike typical fuel rails commonly utilized to supply fuel to fuel injectors 20, fuel line 52 is relatively small in diameter and has a thin wall thickness. Fuel rails typically have an outside diameter on the order of 21 mm, an inside diameter on the order of 13 mm, and a wall thickness on the order of 4 mm where the wall thickness is the radial distance from fuel line inner surface 52*c* to fuel line outer surface 52*d* in a direction perpendicular to fuel line axis 52*a*. In contrast, and by way of non-limiting example only, fuel line 52 has an outside diameter of 10 mm or less, an inside diameter of 6 mm or less, and a wall thickness of 2 mm or less. In one example, the outside diameter of fuel line 52 is 8 mm and the inside diameter is 5 mm, resulting in a wall thickness of 1.5 mm. As shown in the figures, fuel line axis 52*a* need not be linear for its entire length, but may be curved where fuel line 52 is bent as needed to change the direction of fuel line 52 in order to accommodate other elements of internal combustion engine 12. However, portions of fuel line axis 52*a* are linear, particularly where fuel injector sockets 54 are fixed to fuel line 52. In the sections where fuel line axis 52*a* is linear, fuel line outer surface 52*d* is cylindrical in cross section when sectioned perpendicular to fuel line axis 52*a* such that fuel line outer surface 52*d* is centered about fuel line axis 52*a*. Fuel line 52 includes a respective fuel line aperture 52*e* for each fuel injector socket 54 such that each fuel line aperture 52*e* extends from fuel line outer surface 52*d* to fuel line inner surface 52*c*. Each fuel line aperture 52*e* extends along, and is centered about, a respective fuel line aperture axis 52*f* which may be perpendicular to, and intersects with, fuel line axis 52*a*. Each fuel line aperture 52*e* is preferably cylindrical in shape.

The connection of each fuel injector socket 54 to fuel line 52 may be substantially the same, consequently, the subsequent description will refer to one fuel injector socket 54 and one alignment tube 58 with the understanding that the description applies equally to each fuel injector socket 54, each alignment tube 58, and connection thereof to fuel line 52.

Fuel injector socket 54 is made of metal and may be, by way of non-limiting example only, stainless steel such as 304 stainless steel in order to be resistive to corrosive fuel such as gasoline. Fuel injector socket 54 extends along a fuel injector socket axis 54*a*, which may be coincident with fuel line aperture axis 52*f* as shown in the figures, from a fuel injector socket first end 54*b* to a fuel injector socket second end 54*c*. Fuel injector socket 54 includes a fuel injector socket fixation saddle 54*d* which is concave and which is located at fuel injector socket first end 54*b* such that fuel injector socket fixation saddle 54*d* has a concave surface 54*e* which faces toward fuel line 52 and such that fuel line 52 is received within fuel injector socket fixation saddle 54*d*. Concave surface 54*e* is preferably complementary to fuel line outer surface 52*d*, and consequently, is preferably cylindrical to match fuel line outer surface 52*d*. As used herein, cylindrical is not limited to being a full cylinder, but also encompasses a portion of a cylinder. Fuel injector socket 54 also has a fuel injector socket receiving bore 54*f* extending thereinto from fuel injector socket second end 54*c* such that fuel injector inlet conduit 50 is received within fuel injector socket receiving bore 54*f* and sealed thereto, for example with an O-ring as illustrated in the figures. Fuel injector socket receiving bore 54*f* is cylindrical in shape and is preferably centered about fuel injector socket axis 54*a*. Fuel injector socket 54 also has a fuel injector socket aperture 54*g* which extends from concave surface 54*e* to fuel injector socket receiving bore 54*f*. Fuel injector socket aperture 54*g* is preferably centered about fuel injector socket axis 54*a* and is preferably stepped as shown. Consequently, fuel injector socket aperture 54*g* may have a fuel injector socket aperture outer portion 54*h* which is proximal to concave surface 54*e* and a fuel injector socket aperture inner portion 54*i* which is proximal to fuel injector socket receiving bore 54*f*. Each of fuel injector socket aperture outer portion 54*h* and fuel injector socket aperture inner portion 54*i* are preferably cylindrical in shape such that fuel injector socket aperture outer portion 54*h* is larger in diameter than fuel injector socket aperture inner portion 54*i*, thereby forming a fuel injector socket aperture shoulder 54*j* where fuel injector socket aperture outer portion 54*h* and fuel injector socket aperture inner portion 54*i* meet such that fuel injector socket aperture shoulder 54*j* is travers to fuel injector socket axis 54*a* and preferably is perpendicular to fuel injector socket axis 54*a*.

Fuel injector socket 54 may also include a mounting boss 56 fixed there to which is used to secure fuel line assembly 18 to internal combustion engine 12. Mounting boss 56 may be integrally formed as a single piece of material with fuel injector socket 54 or may alternatively be formed from a separate piece of material and fixed to fuel injector socket 54, by way of non-limiting example only, by welding. Mounting boss 56 includes a mounting boss aperture 56*a* extending therethrough along a mounting boss aperture axis 56*b* such that mounting boss aperture axis 56*b* may be parallel to fuel injector socket axis 54*a*. Mounting boss aperture 56*a* receives a mounting bolt 57 therethrough which threadably engages cylinder head 26, thereby clamping mounting boss 56 to cylinder head 26 and fixing fuel line assembly 18 to internal combustion engine 12.

Alignment tube 58 will now be described in greater detail. Alignment tube 58 extends along an alignment tube axis 58*a*, which may be coincident with fuel line aperture axis 52*f* and fuel injector socket axis 54*a* as shown in the figures, from an alignment tube first end 58*b* which is proximal to fuel line inner surface 52*c* to an alignment tube second end 58*c* which is proximal to fuel injector socket receiving bore 54*f*. An alignment tube passage 58*d* extends through alignment tube 58 from alignment tube first end 58*b* to alignment tube second end 58*c*, thereby providing fluid communication from fuel line inner surface 52*c* to fuel injector socket receiving bore 54*f*. Alignment tube passage 58*d* may preferably be centered about alignment tube axis 58*a* as shown in the figures. The outer periphery of alignment tube 58 may be stepped as shown such that alignment tube 58 includes an alignment tube first portion 58*e* which extends from alignment tube first end 58*b* toward alignment tube second end 58*c* and also includes an alignment tube second portion 58*f* which extends from alignment tube first portion 58*e* to alignment tube second end 58*c*. Alignment tube first portion 58*e* may be cylindrical in shape, except for a lead-in portion 58*g* which may be radiused or chamfered in order to facilitate insertion into fuel line aperture 52, wherein alignment tube first portion 58*e* is larger in diameter than alignment tube second portion 58*f*. As a result of the stepped nature of the outer periphery of alignment tube 58 an alignment tube shoulder 58*h* is formed where alignment tube first portion 58*e* and alignment tube second portion 58*f* meet such that alignment tube shoulder 58*h* is travers to alignment tube axis 58*a* and is preferably perpendicular to alignment tube axis 58*a*. Alignment tube shoulder 58*h* is in contact with fuel injector socket aperture shoulder 54*j*, thereby axially positioning alignment tube 58. An alignment tube outer peripheral surface 58*i* extends circumferentially around alignment tube first portion 58*e* and alignment tube second portion 58*f* such that a section of alignment tube outer peripheral surface 58*i* is circumferentially surrounded by fuel line aperture 52*e*, another section of alignment tube outer peripheral surface 58*i* is circumferentially surrounded by fuel injector socket aperture outer portion 54*h*, and yet another section of alignment tube outer peripheral surface 58*i* is circumferentially surrounded by fuel injector socket aperture inner portion 54*i*. A section of alignment tube first portion 58*e* which is closest to alignment tube first end 58*b* is located within fuel line aperture 52*e*, either in an interference fit or a clearance fit; a section of alignment tube first portion 58*e* which is closest to alignment tube shoulder 58*h* is located within fuel injector socket aperture outer portion 54*h*, either in an interference fit or a clearance fit; and alignment tube second portion 58*f* is located within fuel injector socket aperture inner portion 54*i*, either in an interference fit or a clearance fit. However, it is preferable that at least alignment tube second portion 58*f* is located within fuel injector socket aperture inner portion 54*i* in an interference fit, thereby retaining alignment tube 58 and preventing alignment tube 58 from moving out of position.

The diameter of alignment tube passage 58*d* and the length of alignment tube 58 from alignment tube first end 58*b* to alignment tube second end 58*c* (and consequently the length of alignment tube passage 58*d* along alignment tube axis 58*a*) can be selected in order to minimize or eliminate pressure pulsations created by the rapid cyclic opening and closing of fuel injectors 20. The diameter of alignment tube passage 58*d* and the length of alignment tube 58 from alignment tube first end 58*b* may be selected based on the specific details of fuel system 10 where the diameter and length may be determined through one or more of mathematical calculation, computer modeling, and empirical testing.

Figure 3:
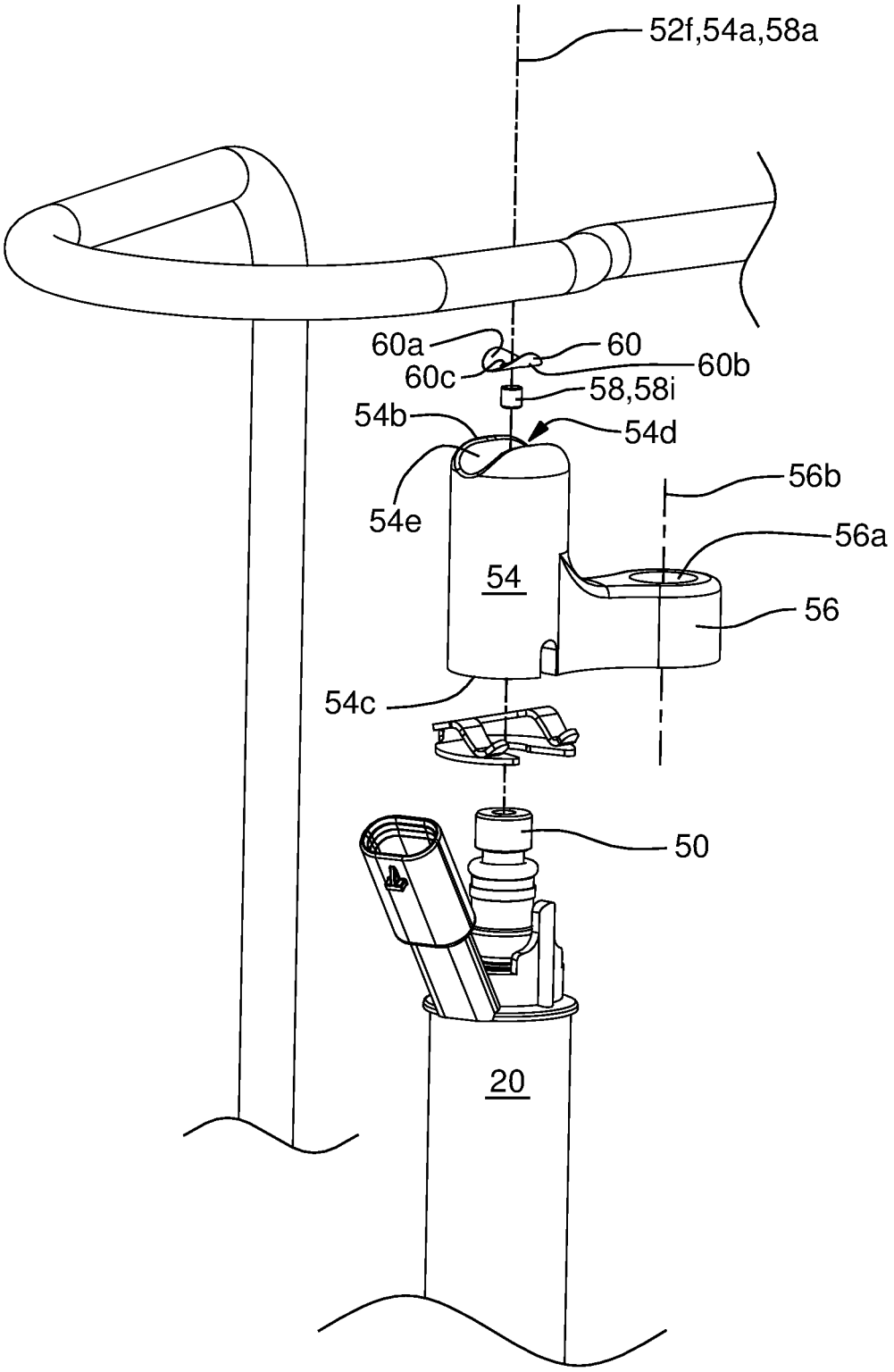
FIG. 3 is an exploded isometric view of a portion of FIG. 2.
Figure 4:
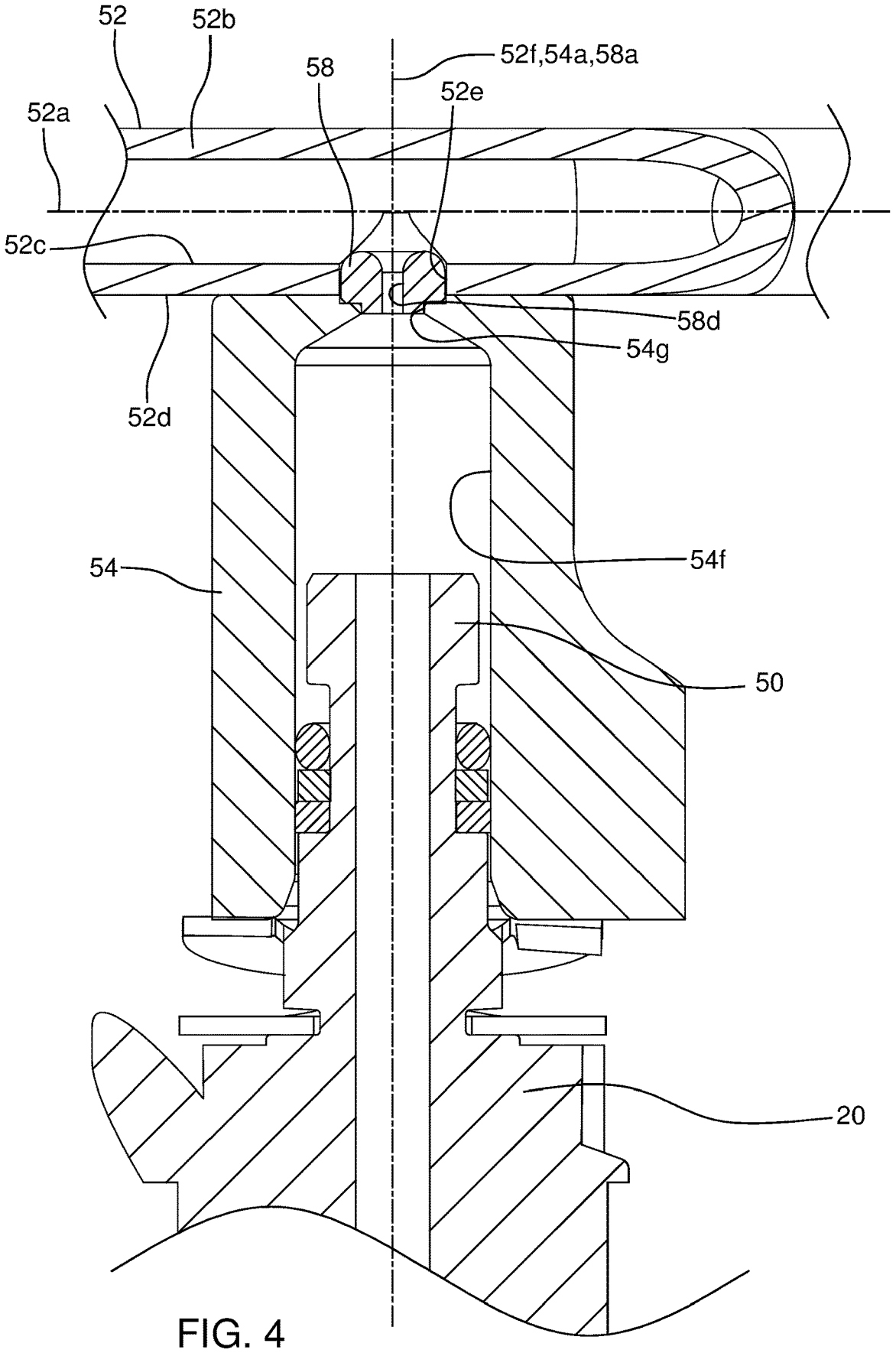
FIG. 4 is a cross-sectional view of a portion of FIG. 2.
Figure 5:
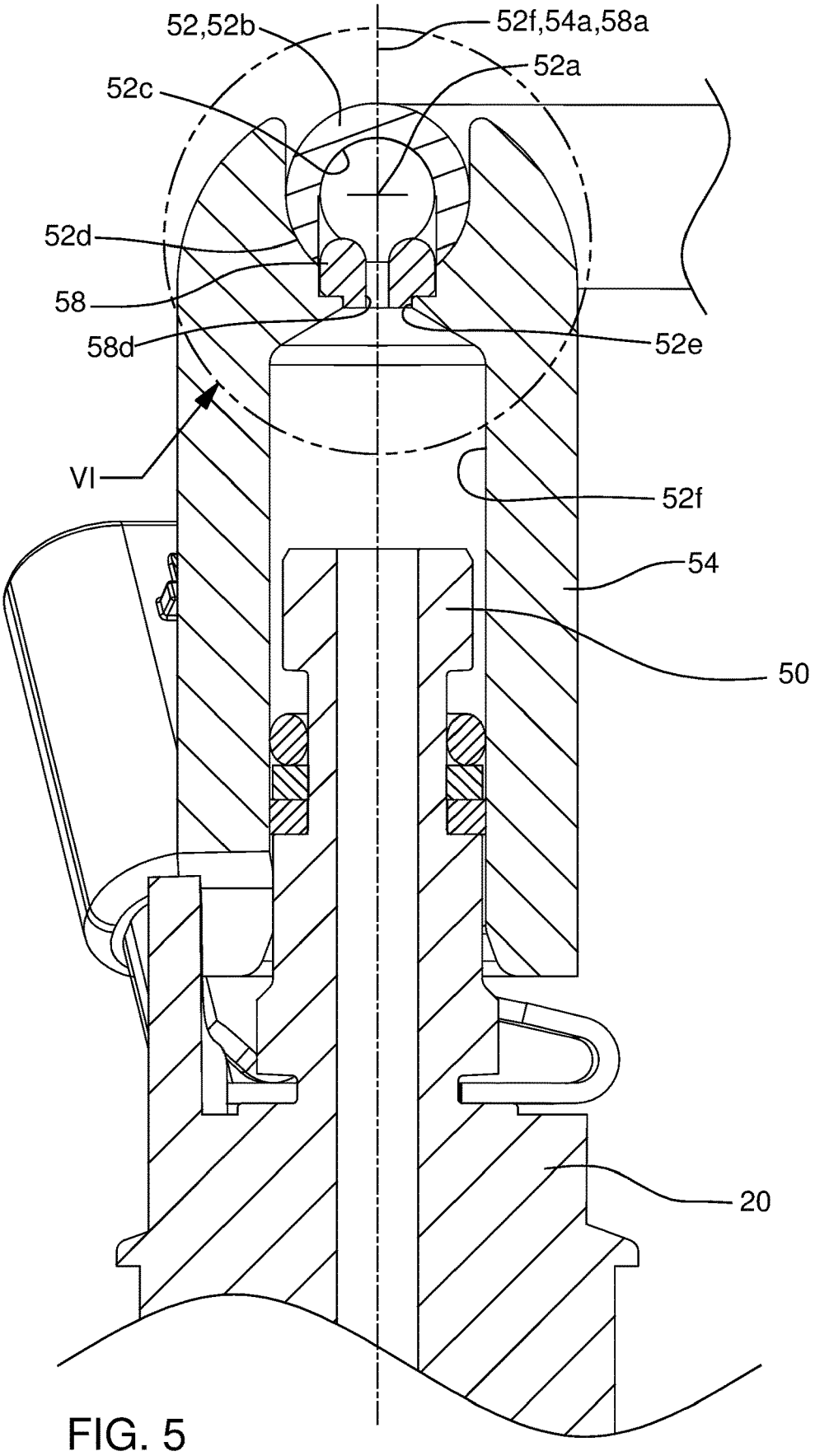
FIG. 5 is another cross-section al view of a portion of FIG. 2, now taken through a cutting plane which is rotated 90° compared to FIG. 4.
Figure 6:
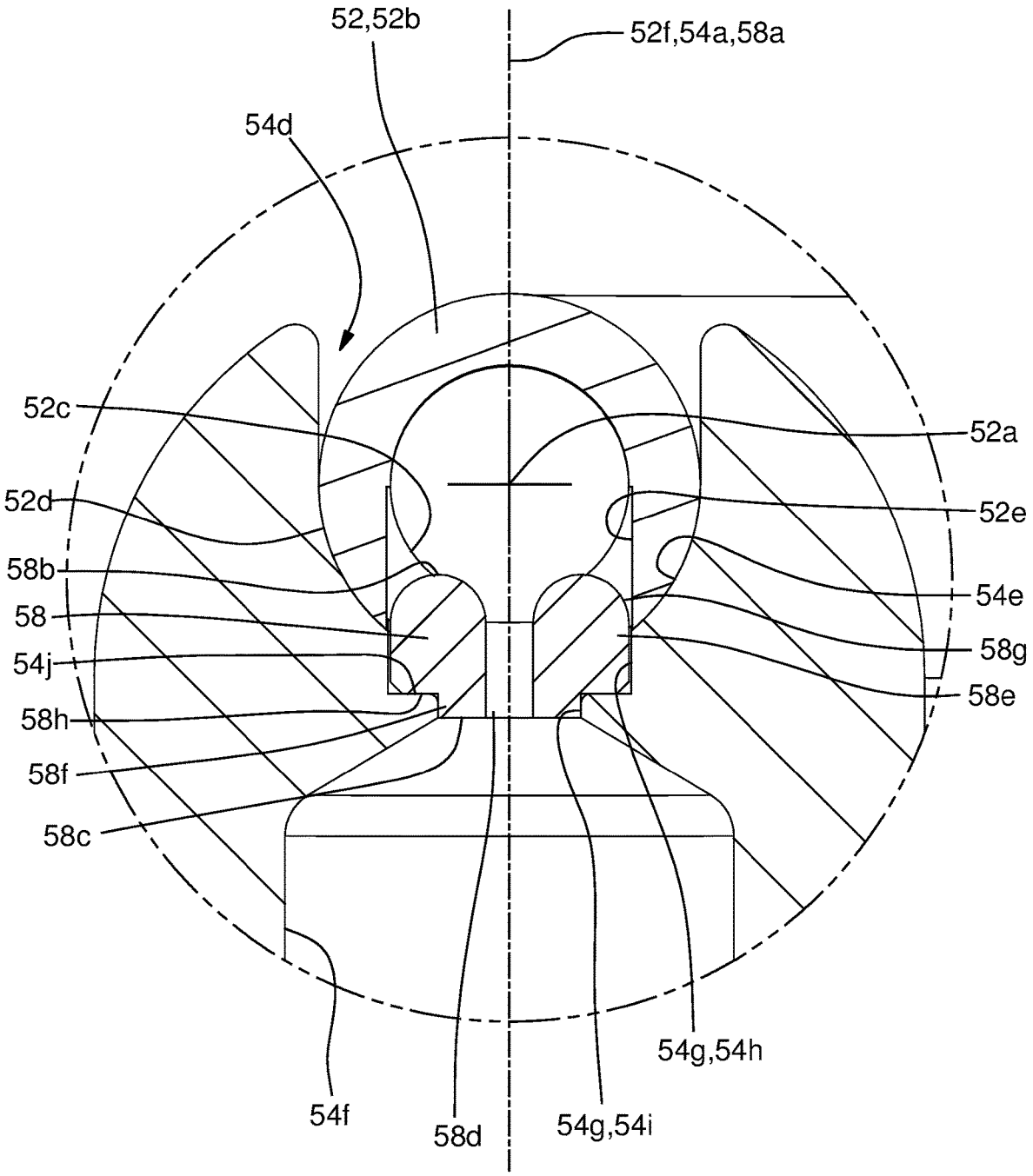
FIG. 6 is an enlargement of a portion of FIG. 5.

A braze material 60 is used to prevent leakage of fuel between the interface of fuel line 52 and fuel injector socket 54 and also to fix fuel injector socket 54 to fuel line 52. As shown in FIG. 3, braze material 60 may be provided as a ring, contoured to match fuel line outer surface 52*d* and concave surface 54*e*, in which opposing surfaces 60*a* and 60*b* of braze material 60 are placed against fuel line outer surface 52*d* and concave surface 54*e* of fuel injector socket 54 respectively such that and a braze material aperture 60*c*, which extends therethrough from opposing surface 60*a* to opposing surface 60*b*, allows alignment tube 58 to pass therethrough. Braze material 60 may be, by way of non-limiting example only, copper or a copper alloy, or any other brazing material compatible with the particular materials selected for fuel line 52 and fuel injector socket 54 where the selection of the particular material would be known to a practitioner of ordinary skill in the art. After fuel line 52, fuel injector socket 54, alignment tube 58, and braze material 60 are assembled to each other, fuel line assembly 18 may be placed in a brazing oven where the temperature of fuel line assembly 18 is raised to be above the melting temperature of braze material 60 to cause braze material 60 to flow, thereby causing braze material 60 to seal and join fuel injector socket 54 to fuel line 52 when cooled. It should be noted that the stepped nature of fuel injector socket aperture 54*g* and alignment tube 58 minimizes the likelihood of braze material 60 from flowing past the interface of fuel injector socket aperture 54*g* and alignment tube 58. The brazing process will not be discussed further herein and would be known to a practitioner of ordinary skill in the art. In one non-limiting alternative, braze material 60 may be omitted and sealing and fixation of fuel injector socket 54 to fuel line 52 may be provided by welding fuel injector socket 54 to fuel line 52.

Fuel line assembly 18 as described herein allows for use of fuel line 52 having a relatively small wall thickness which can be easily shaped to be non-linear, thereby allowing for easier packaging of fuel line assembly 18 on internal combustion engine 12. Furthermore, pressure pulsation damping characteristics can be easily tailored by selecting the diameter and length of alignment tube passage 58*d*. Even furthermore, alignment of fuel injector socket 54 to fuel line 52 can be maintained during manufacturing of fuel line assembly 18 through use of alignment tube 58.

While the invention has been described by reference to various specific embodiments, it should be understood that numerous changes may be made within the spirit and scope of the inventive concepts described. Accordingly, it is intended that the invention not be limited to the described embodiments, but rather only to the extent set forth in the claims that follow.

We claim:

1. A fuel line assembly which supplies fuel to a fuel injector of a fuel consuming device, said fuel line assembly comprising:

a fuel line having a fuel line tubular wall which extends along a fuel line axis and has a fuel line inner surface and a fuel line outer surface such that a fuel line aperture extends from said fuel line outer surface to said fuel line inner surface;

a fuel injector socket which is tubular and which extends from a fuel injector socket first end to a fuel injector socket second end, said fuel injector socket having a fuel injector socket fixation saddle which is concave at said fuel injector socket first end within which said fuel line is received such that said fuel injector socket fixation saddle has a concave surface facing toward said fuel line, said fuel injector socket also having a fuel injector socket receiving bore extending thereinto from said fuel injector socket second end which is configured to receive said fuel injector therewithin, said fuel injector socket also having a fuel injector socket aperture extending from said concave surface to said fuel injector socket receiving bore; and an alignment tube extending from an alignment tube first end to an alignment tube second end, said alignment tube having an alignment tube passage extending therethrough from said alignment tube first end to said alignment tube second end, said alignment tube also having an alignment tube outer peripheral surface such that a portion of said alignment tube outer peripheral surface is circumferentially surrounded by said fuel line aperture and such that another portion of said alignment tube outer peripheral surface is circumferentially surrounded by said fuel injector socket aperture such that said alignment tube passage provides fluid communication between said fuel line inner surface and said fuel injector socket receiving bore.

2. The fuel line assembly as in claim 1, wherein said fuel injector socket aperture is stepped such that said fuel injector socket aperture has a fuel injector socket aperture outer portion which is proximal to said concave surface and a fuel injector socket aperture inner portion which is proximal to said fuel injector socket receiving bore such that said fuel injector socket aperture outer portion is larger in diameter than said fuel injector socket aperture inner portion.

3. The fuel line assembly as in claim 2, wherein a fuel injector socket aperture shoulder is formed where said fuel injector socket aperture outer portion meets said fuel injector socket aperture inner portion such that said alignment tube is in contact with said fuel injector socket aperture shoulder.

4. The fuel line assembly as in claim 3, wherein an outer periphery of said alignment tube is stepped such that said alignment tube has an alignment tube first portion which extends from said alignment tube first end toward said alignment tube second end and also includes an alignment tube second portion which extends from said alignment tube first portion to said alignment tube second end wherein said alignment tube first portion is larger in diameter than said alignment tube second portion, thereby forming an alignment tube shoulder where said alignment tube first portion meets said alignment tube first portion.

5. The fuel line assembly as in claim 4, wherein said alignment tube shoulder is in contact with said fuel injector socket aperture shoulder.

6. The fuel line assembly as in claim 4, wherein a portion of said alignment tube first portion is circumferentially surrounded by said fuel line aperture and another portion of said alignment tube first portion is circumferentially surrounded by said fuel injector socket aperture outer portion.

7. The fuel line assembly as in claim 6, wherein said alignment tube second portion is circumferentially surrounded by said fuel injector socket aperture inner portion.

8. The fuel line assembly as in claim 7, wherein said alignment tube second portion is received within said fuel injector socket aperture inner portion in an interference fit.

9. The fuel line assembly as in claim 1, wherein said fuel line assembly further comprises a braze material between said fuel line outer surface and said concave surface such that said braze material fixes said fuel injector socket to said fuel line and such that said braze material prevents leakage between said fuel line outer surface and said concave surface.

10. The fuel line assembly as in claim 9, wherein said braze material circumferentially surrounds said alignment tube.

11. The fuel line assembly as in claim 1, wherein said fuel line aperture is centered about a fuel line aperture axis which is perpendicular to said fuel line axis.

12. The fuel line assembly as in claim 11, wherein said fuel injector socket aperture is centered about a fuel injector socket axis which is coincident with said fuel line aperture axis.

13. The fuel line assembly as in claim 1, wherein said fuel line outer surface is centered about said fuel line axis and is cylindrical in cross section when sectioned perpendicular to said fuel line axis.

14. The fuel line assembly as in claim 1, wherein a wall thickness of said fuel line tubular wall is 2 mm or less.

15. The fuel line assembly as in claim 14, wherein an outside diameter of said fuel line is 10 mm or less.

16. A fuel line assembly which supplies fuel to a fuel injector of a fuel consuming device, said fuel line assembly comprising:

a fuel line having a fuel line tubular wall which extends along a fuel line axis and has a fuel line inner surface and a fuel line outer surface such that a fuel line aperture extends from said fuel line outer surface to said fuel line inner surface;

a fuel injector socket which is tubular, said fuel injector socket having at one end a fuel injector socket fixation saddle which is concave within which said fuel line is received such that said fuel injector socket fixation saddle has a concave surface facing toward said fuel line, said fuel injector socket also having at another end a fuel injector socket receiving bore extending thereinto which is configured to receive said fuel injector therewithin such that a fuel injector socket aperture extends from said concave surface to said fuel injector socket receiving bore;

an alignment tube having an alignment tube passage extending therethrough which provides fluid communication between said fuel line inner surface and said fuel injector socket receiving bore, wherein a portion of said alignment tube is circumferentially surrounded by said fuel line aperture and wherein another portion of said alignment tube is circumferentially surrounded by said fuel injector socket aperture.

* * * * *